United States Patent [19]

Takashima

[11] Patent Number: 4,857,023

[45] Date of Patent: Aug. 15, 1989

[54] COOLING WATER DRAINAGE SYSTEM FOR MARINE PROPULSION ENGINE

[75] Inventor: Kazutoshi Takashima, Hamamatsu, Japan

[73] Assignee: Sanshin Kogyo Kabushiki Kaisha, Hamamatsu, Japan

[21] Appl. No.: 155,209

[22] Filed: Feb. 12, 1988

[30] Foreign Application Priority Data

Feb. 21, 1987 [JP] Japan ..... 62-36906

[51] Int. Cl.[4] ..... B63H 21/10

[52] U.S. Cl. ..... 440/88

[58] Field of Search ..... 123/41.02, 41.44; 165/12, 44; 440/88

[56] References Cited

U.S. PATENT DOCUMENTS

| | | | |
|---|---|---|---|
| 4,312,304 | 1/1982 | Tyner | 123/41.74 |
| 4,728,306 | 3/1988 | Schneider | 123/41.02 |
| 4,741,715 | 5/1988 | Hedge | 440/88 |
| 4,758,190 | 7/1988 | Van Vuren | 440/88 |

*Primary Examiner*—Sherman D. Basinger
*Assistant Examiner*—Thomas J. Brahan
*Attorney, Agent, or Firm*—Ernest A. Beutler

[57] ABSTRACT

An arrangement for purging the cooling jacket of a marine engine from coolant when the engine is stopped. The system comprises an electrically operated pump that is operated for a predetermined period of time once the engine is shut off so as to purge the cooling jacket.

6 Claims, 3 Drawing Sheets

COOLING WATER DRAINAGE SYSTEM FOR MARINE PROPULSION ENGINE

BACKGROUND OF THE INVENTION

This invention relates to a cooling water drainage system for a marine propulsion engine and more particularly to a system for purging the engine cooling system of water when engine operation is discontinued.

In many marine applications, the watercraft is powered by a liquid cooled internal combustion engine. Such engines are employed both for inboard, inboard/-outboard and outboard drive arrangements. Although closed cooling systems have been proposed for such applications, such closed systems have some disadvantages. Therefore, it is the normal practice with such applications for the coolant to be drawn for the engine from the body of water in which the watercraft is operated and then returned back to that water body after is has been circulated through the engine cooling system. Although such arrangements offer considerable advantages, simplicity being a major one of them, there are some disadvantages.

With watercraft there may be long periods of time when the engine is not being operated. Under these conditions, it is desirable to ensure that the cooling system is purged of water. If water is permitted to remain in the engine cooling system, particularly in salt water environments, corrosion can become a significant problem. In addition, if the temperature becomes low enough, there is always a danger of freezing. There are many instances, however, where the water may remain in at least a portion of the engine cooling jacket once the engine is shut off. This may happen in an inboard application if the engine, as is the normal case, is positioned below the level of water in which the watercraft is operating. Furthermore, with inboard/outboard drive arrangements the water is frequently drawn in through the pivotally supported outboard drive unit of the arrangement. This outboard drive unit is tilted up when the watercraft is not in use and hence coolant may be trapped in the engine cooling jacket under these circumstances. A similar situation can arise with outboard motors.

It is, therefore, a principle object of this invention to provide an improved coolant water system for a marine propulsion engine wherein coolant is purged from the engine cooling jacket when the engine is not being operated.

SUMMARY OF THE INVENTION

This invention is adapted to be embodied in a marine propulsion system for a watercraft that includes an engine for powering the watercraft and which engine has a cooling jacket. Means are provided for circulating water from the body of water in which the watercraft is operating through the cooling jacket and returning the coolant back to the body of water after this circulation. In accordance with this feature of the invention, means are provided for pumping water from the cooling jacket when the engine is not running.

DETAILED DESCRIPTION OF THE PREFERRED EMBODIMENTS OF THE INVENTION

Figure 1:
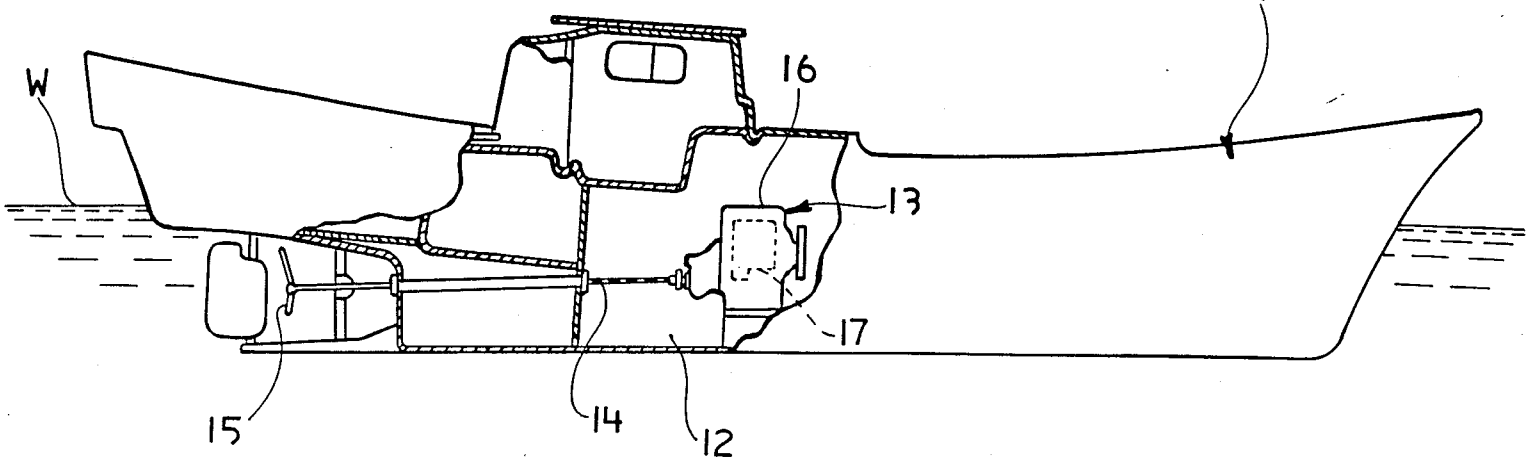
FIG. 1 is a side elevational view, with a portion broken away, showing a watercraft to illustrate the problem solved by the invention and also illustrating a typical environment in which the invention may be employed.

Referring first to FIG. 1, a watercraft which shows a typical environment in which the invention may be employed is identified generally by the reference numeral 11. The watercraft 11 is designed to be operated in a body of water, indicated generally by the reference character W, and is configured in such a way that an engine compartment 14 will be normally positioned below the level of the water W when the watercraft 11 is in operation. An internal combustion engine 13 is positioned within the engine compartment 12 and powers the watercraft through a drive shaft 14 which drives a propeller 15 in a known manner.

The engine 13 is of the water cooled type and to this end its cylinder block 16 is provided with a cooling jacket, indicated generally at 17, through which coolant is circulated. The coolant is delivered from the body of water W through a suitable water inlet and is discharged back into the body. Circulation is achieved by means of a positive displacement pump 18, shown schematically in FIG. 2.

Figure 2:
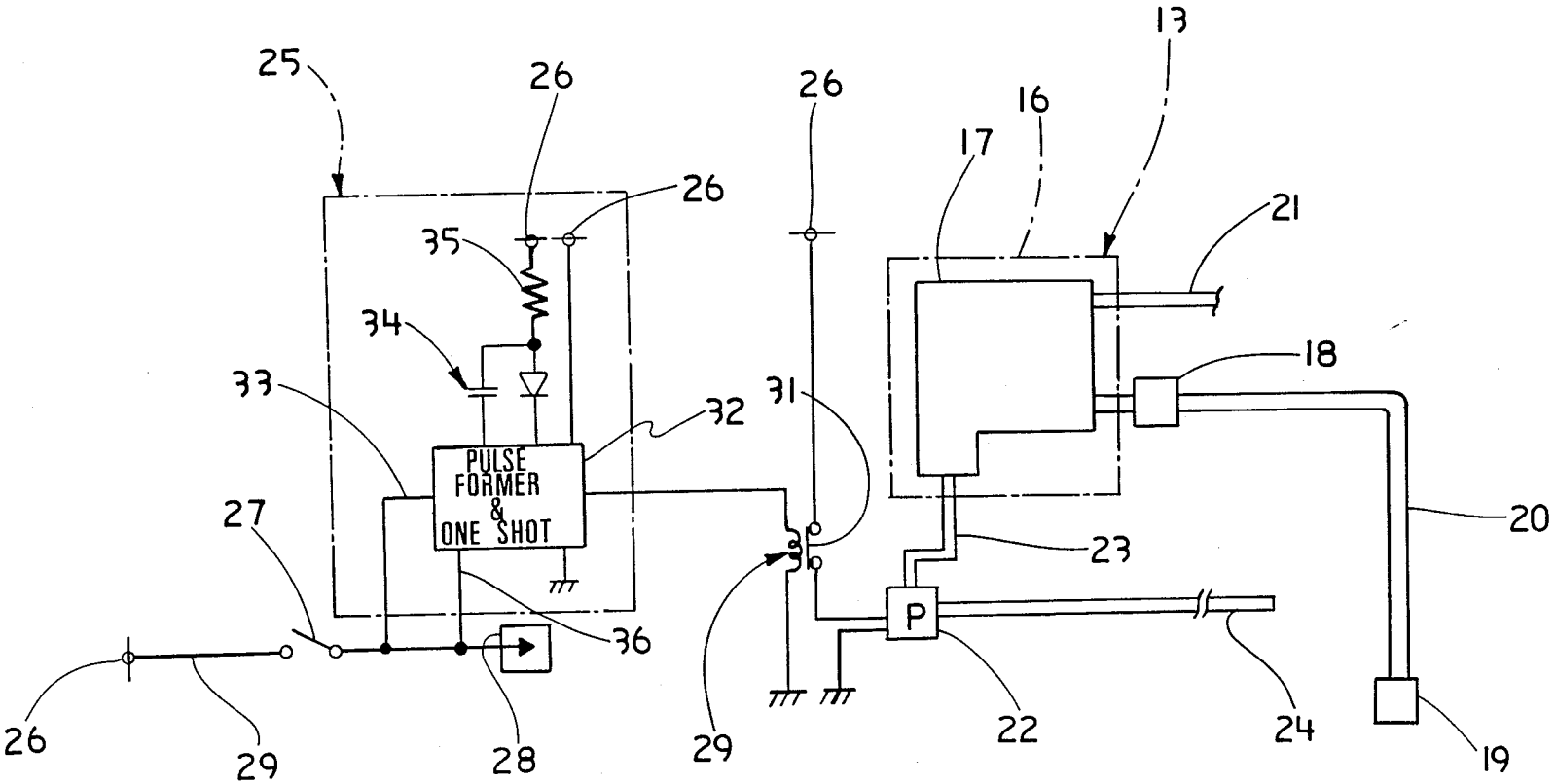
FIG. 2 is a partially schematic diagram showing the system constructed in accordance with an embodiment of the invention.

Referring now primarily to FIG. 2, it will be noted that the pump 18 draws water from the body of water W through an inlet with a strainer 19 and delivery pipe. The coolant which is circulated through the cooling jacket 17 is discharged back to the body of water W through a discharge conduit 21.

It should be noted that the description thus far has been that of an inboard type of watercraft which is powered by a water cooled internal combustion engine that has its cooling jacket disposed at least in part below the level of the body of water in which the watercraft is operated. It is to be understood, however, that the invention may be equally applicable to inboard/outboard drive arrangements or outboard motors per se, since these arrangements also present the problem solved by this invention, as aforedescribed.

When the engine 13 is stopped, water will remain in its cooling jacket 17. This is also true in connection with inboard/outboard dirves wherein it is the normal practice to tilt up the outboard drive section, in which the water inlets and outlets for the engine cooling jacket are provided once the engine is stopped. Also, the problem may be present in outboard motors if positive displacement water pumps are employed since when the engine is stopped, even though its cooling jacket is above the water level, the positive displacement pump will preclude water from draining back out of the engine cooling jacket. In accordance with the invention, therefore, there is provided an electrically operated pump 22 that draws water from the engine cooling jacket 17 through a conduit 23 and discharges it back to the body of water in which the watercraft is operating through a discharge conduit 24. There is provided a control circuit 25 that controls the operation of the electric pump 22 so as to operate it for a period of time after the engine 13 has been shut down so as to purge the cooling jacket 17 of coolant. In FIG. 2 a source of electrical current or voltage is indicated at 26 which may comprise one of the terminals of a battery or series of batteries carried by the watercraft 11. The main ignition switch 27 connects the source 26 with the engine ignition system, indicated schematically at 28 through a conductor 29. When the switch 27 is closed, the engine ignition circuit 28 will be energized and the engine 13 operated. When the switch 27 is open, the ignition circuit 28 will be disabled and the engine 13 will be stopped.

Figure 3:
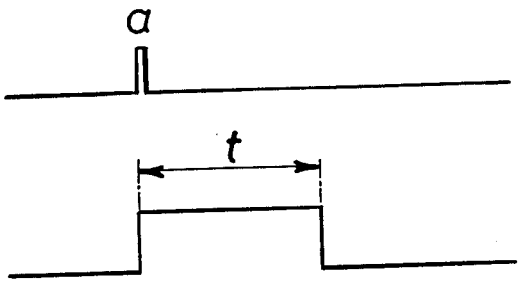
FIG. 3 is a schematic view showing how the system operates when the engine has been turned off.

The control circuit 25 includes a timer and operates so as to energize a relay 29 and close a normally opened relay contact 31 to energize the pump 22 for a period of time once the switch 27 is open. This timer circuit includes pulse forming circuit and one shot multi-vibrator 32 that has its state changed when the voltage in the line 29, as supplied through a conductor 33, goes to zero when the switch 27 is opened. Under this condition, a circuit comprised of a capacitor 34 and resistor 35 provide a voltage to the relay 29 for a period determined by the tuning of the capacitor 34 and resistor 35 so as to energize the relay 29 and close the contact 31. As shown in FIG. 3, when the pulse is generated by the opening of the switch 27 (which pulse is designated at a) the relay 29 will be energized for a time t so as to operate the pump 22 for a sufficient time so as to ensure purging of the cooling jacket 17 of water.

Figure 4:
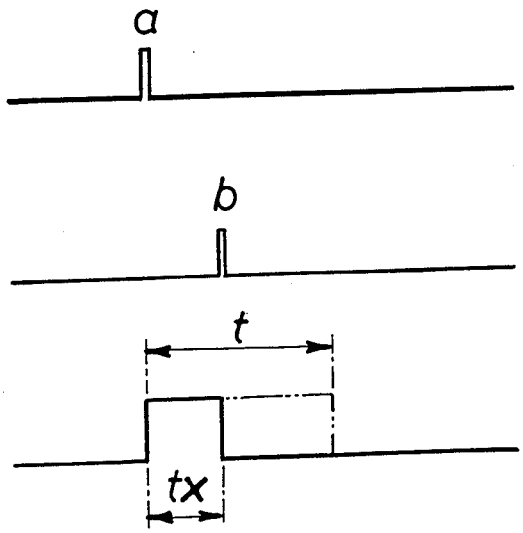
FIG. 4 is a schematic view showing how the arrangement operates when the engine is shut off and then is restarted.

The switch 27 is again closed before the time t has run out, a positive voltage signal will be transmitted to the circuit 32 through a conductor 36 and the one shot pulse former circuit 32 will be reset so as to turn off the supply of voltage to the relay 29. This situation is shown in FIG. 4, wherein the resetting pulse b occurs at a time tx which is less than the time t. The output signal of the circuit 32 then is cut off and the pump 22 will not be driven so as to ensure that it will not deplete the water in the cooling jacket 17 when the engine is running.

It should be readily apparent from the foregoing description that an extremely effective system is described for purging the cooling jacket of a marine propulsion engine from coolant when the engine is stopped. Although the invention has been described in conjunction with a spark ignited engine, it should be understood that the same principle can be applied to engines having other forms of ignition systems or diesel engines by activating a circuit once the engine kill switch is closed. Various other changes in modifications may be made without departing from the spirit and scope of the invention, as defined by the appended claims.

I claim:

1. In a marine propulsion system for a watercraft, an engine for powering said watercraft, said engine having a cooling jacket and means for circulating water from the body of water in which the watercraft is operating through said cooling jacket and returning the circulated water back to the body of water, the improvement comprising a pump driven when said engine is not running and having an inlet communicating with said cooling jacket and an outlet communicating with the body of water for emptying said cooling jacket of water when said engine is not running without drawing further water into said cooling jacket.

2. In a marine propulsion system as set forth in claim 1 wherein the pump for emptying water from the cooling jacket is responsive to the stopping of the engine for pumping water from the cooling jacket when the engine is stopped.

3. In a marine propulsion system as set forth in claim 2 wherein the pump is operated for a predetermined period of time when the engine is stopped.

4. In a marine propulsion system as set forth in claim 3 further including means for stopping the operation of the pump if the engine is restarted during the predetermined period of time.

5. In a marine propulsion system as set forth in claim 1 wherein the pump comprises an electrically operated pump.

6. In a marine propulsion system as set forth in claim 5 wherein the pump is a pump other than the means for circulating water through the engine cooling jacket during running of the engine.

* * * * *